US007604038B2

(12) United States Patent
Kim

(10) Patent No.: US 7,604,038 B2
(45) Date of Patent: Oct. 20, 2009

(54) HEAD FACE SLIDE CORE OF DIE CASTING MOLD FOR CYLINDER BLOCK

(75) Inventor: Cheonhee Kim, Ulsan (KR)

(73) Assignee: Hyundai Motor Company, Seoul (KR)

( * ) Notice: Subject to any disclaimer, the term of this patent is extended or adjusted under 35 U.S.C. 154(b) by 510 days.

(21) Appl. No.: 11/641,404

(22) Filed: Dec. 19, 2006

(65) Prior Publication Data

US 2008/0115908 A1 May 22, 2008

(30) Foreign Application Priority Data

Nov. 21, 2006 (KR) ..... 10-2006-0115221

(51) Int. Cl.
*B22D 17/24* (2006.01)

(52) U.S. Cl. ..... 164/340; 164/341

(58) Field of Classification Search ..... 164/137, 164/302, 340, 341, 369
See application file for complete search history.

(56) References Cited

U.S. PATENT DOCUMENTS 5,119,881 A * 6/1992 Cagle ..... 164/137

FOREIGN PATENT DOCUMENTS

JP 6-55251 A * 3/1994
JP 8-276244 A * 10/1996

* cited by examiner

*Primary Examiner*—Kevin P Kerns
(74) *Attorney, Agent, or Firm*—Morgan, Lewis & Bockius LLP

(57) ABSTRACT

A head face slide core of a die casting mold for a cylinder block includes: a first core die with a water jacket forming portion for forming a water jacket, a head bolt forming portion for forming a head bolt, and a bore pin for forming a cylinder bore provided on a front surface of the first core die; a second core die coupled to a rear surface of the first core die; a cylinder having a piston; a core holder coupled to a rear surface of the second core die and connected to the piston; and a bore pin return plate between the first and second core dies and connected to the bore pin.

8 Claims, 5 Drawing Sheets

HEAD FACE SLIDE CORE OF DIE CASTING MOLD FOR CYLINDER BLOCK

CROSS-REFERENCE TO RELATED APPLICATION

This application claims priority to and the benefit of Korean Patent Application No. 10-2006-0115221 filed in the Korean Intellectual Property Office on Nov. 21, 2006, the entire contents of which are incorporated herein by reference.

BACKGROUND OF THE INVENTION (a) Field of the Invention

The present invention relates to a head face slide core of a die casting mold for a cylinder block. More particularly, the present invention relates to a head face slide core dispersing an adhesive strength between a product and the slide core when the slide core is separated from the product after forming the head face of the cylinder block.

(b) Description of the Related Art

A conventional head face slide core forms a bore, a water jacket, and a head bolt of the cylinder block, and is installed in a movable die and a movable holder. The head face slide core is connected to and receives hydraulic pressure from a cylinder to slide in the movable die and the movable holder.

The conventional head face slide core includes a first core die, a second core die, a core holder, and a cylinder bracket.

According to the conventional head face slide core, the cylinder must apply a strength to the core dies larger than an adhesive strength between the product and the head face slide core.

Fatigue stress may be applied to the bolts by a reciprocating movement of the piston, and thus, the bolts may be broken.

The bolts cannot be installed symmetrically due to the positions of a cooling pipe and the bore pin. Therefore, the load may be concentrated to a specific bolt, and thus, the specific bolt may be broken.

In addition, the number of bolts can not be increased due to the positions of the cooling pipe and the bore pin.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a head face slide core of a die casting mold for a cylinder block that disperses the adhesive strength between a product and the slide core when the slide core is separated from the product after forming the head face of the cylinder block.

A head face slide core of a die casting mold for a cylinder block according to an exemplary embodiment of the present invention includes a first core die provided with a water jacket forming portion for forming a water jacket, and a head bolt forming portion for forming a head bolt, both on a front surface of the first core die; a second core die coupled to a rear surface of the first core die; a cylinder provided with a piston operated by hydraulic pressure; a core holder coupled to a rear surface of the second core die and connected to the piston; a bore pin for forming a cylinder bore, the bore pin protruding from the front surface of the first core die; and a bore pin return plate disposed between the first and second core dies and connected to the bore pin.

The bore pin may be connected to the bore pin return plate by an operating rod.

The operating rod may penetrate and slide through the first core die.

The first core die may be coupled to the second core die by a sliding rod.

The bore pin return plate may slide a predetermined distance between the first and second core dies along the sliding rod.

The bore pin return plate may move forward together with the second core die after contacting the second core die when the head face slide core moves forward.

The bore pin return plate may move backward together with the first core die after being contacted with the first core die when the head face slide core moves backward.

The operating rod may be integrally formed with the bore pin.

DETAILED DESCRIPTION OF THE PREFERRED EMBODIMENTS

An exemplary embodiment of the present invention will hereinafter be described in detail with reference to the accompanying drawings.

Figure 1:
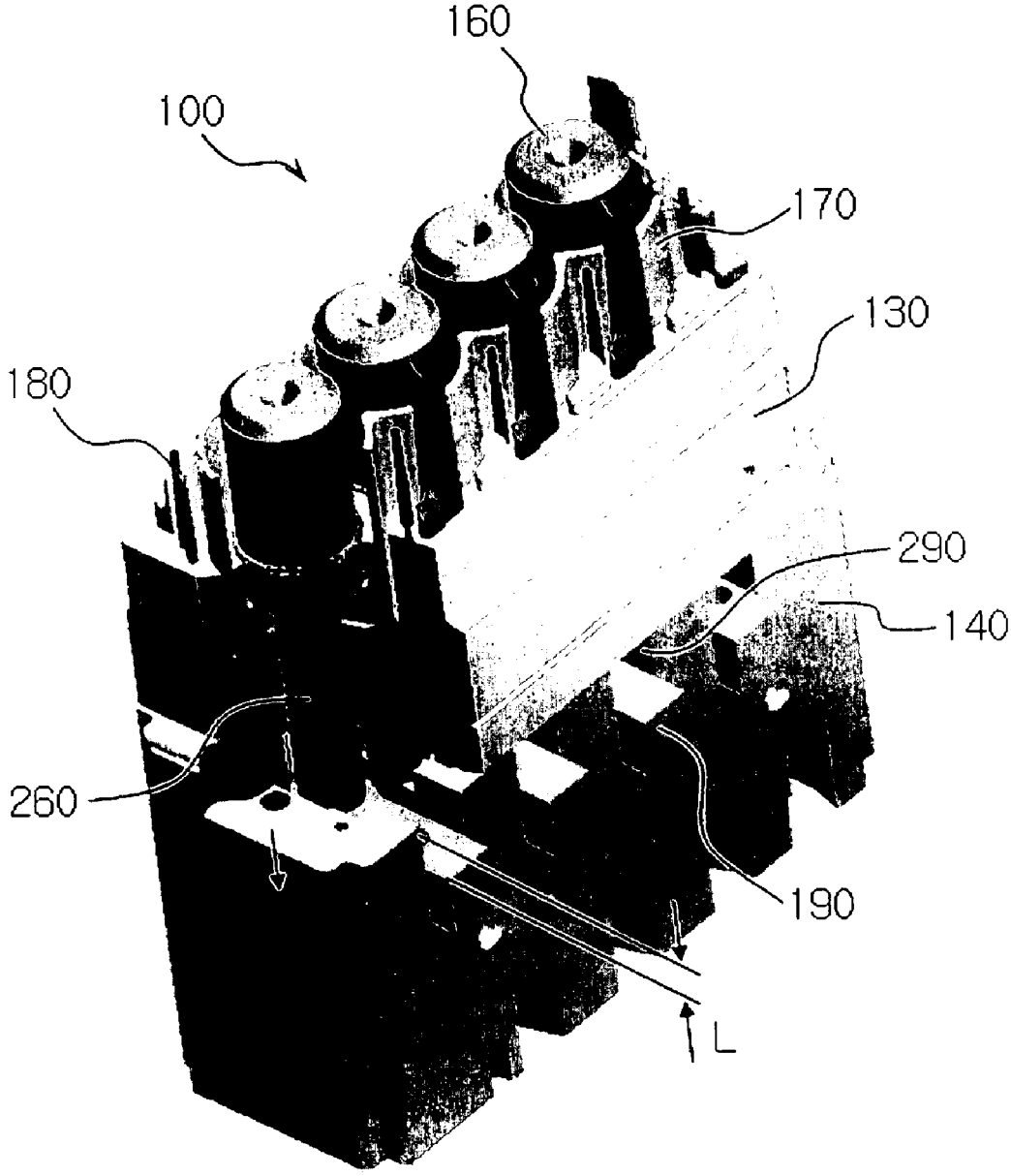
FIG. 1 is a perspective view of a head face slide core of a die casting mold for a cylinder block according to an exemplary embodiment of the present invention.
Figure 2:
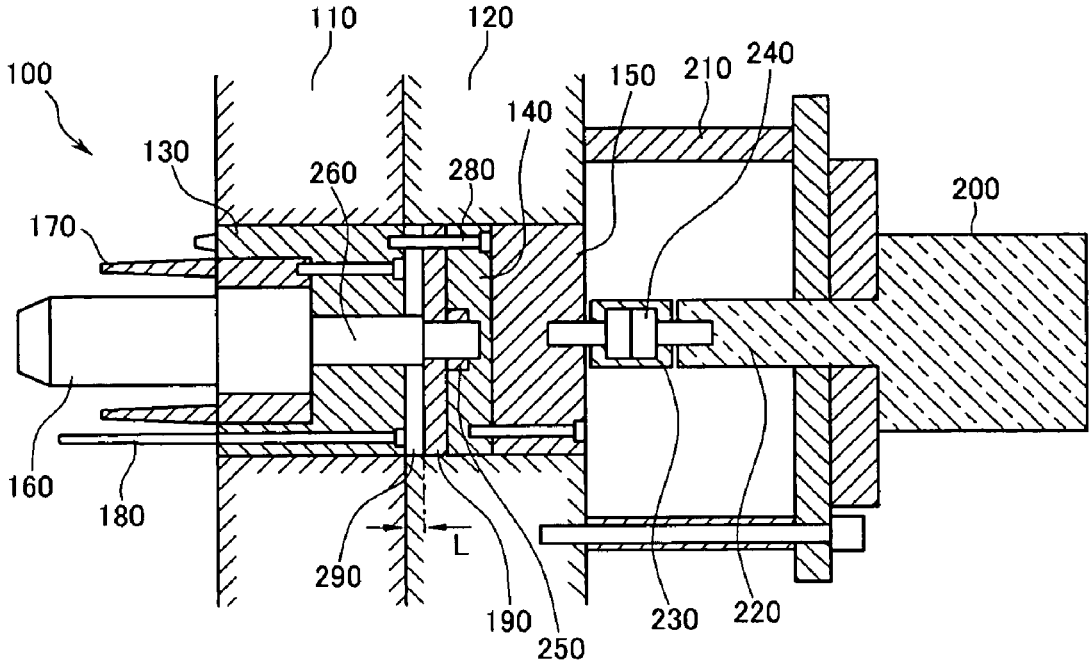
FIG. 2 is a cross-sectional view of the head face slide core of a die casting mold for a cylinder block shown in FIG. 1.

As shown in FIG. 1 and FIG. 2, a head face slide core 100 of a die casting mold for a cylinder block according to an exemplary embodiment of the present invention is slidably installed in a movable die 110 and a movable holder 120.

The head face slide core 100 includes a first core die 130, a second core die 140, a core holder 150, a cylinder 200, a bore pin 160, and a bore pin return plate 190.

The first core die 130 is provided with a water jacket forming portion 170 for forming a water jacket and a head bolt forming portion 180 for forming a head bolt on a front surface thereof.

The second core die 140 is coupled to a rear surface of the first core die 130. A plurality of insert holes 290 is provided between the first and second core dies 130 and 140, and the bore pin return plate 190 is inserted in the insert hole 290. In addition, the first core die 130 is coupled to the second core die 140 by a sliding rod 280.

The core holder 150 is coupled to a rear surface of the second core die 140. In addition, the core holder 150 is connected to and receives hydraulic pressure from a cylinder 200.

The cylinder 200 includes a piston 220 that is operated by the hydraulic pressure of the cylinder 200. The piston 220 is connected to the core holder 150 by a joint 240 and a coupling 230. Therefore, the cylinder 200 moves the core holder 150, which moves the first and second core dies 130 and 140.

The bore pin 160 protrudes from the front surface of the first core die 130, and forms a cylinder bore. One end of the bore pin 160 is inserted and slides in the first core die 130.

The bore pin return plate 190 is inserted in the insert hole 290 formed between the first and second core dies 130 and 140. The bore pin return plate 190 is fixedly connected to the bore pin 160 by an operating rod 260. The sliding rod 280 penetrates the bore pin return plate 190, and the bore pin return plate 190 slides along the sliding rod 280 a distance L within the insert hole 290.

The operating rod 260 connects the bore pin 160 to the bore pin return plate 190. The operating rod 260 is inserted in and slides in the first core die 130. The operating rod 260 may be integrally formed with the bore pin 160, and one end of the operating rod 260 is connected to the bore pin return plate 190 by a fixed member 250.

In addition, a cylinder bracket 210 connects the cylinder 200 with the movable holder 120.

Hereinafter, referring to FIG. 3 and FIG. 4, an operation of the head face slide core of the die casting mold for the cylinder block according to an exemplary embodiment of the present invention will be described in detail.

Figure 3A:
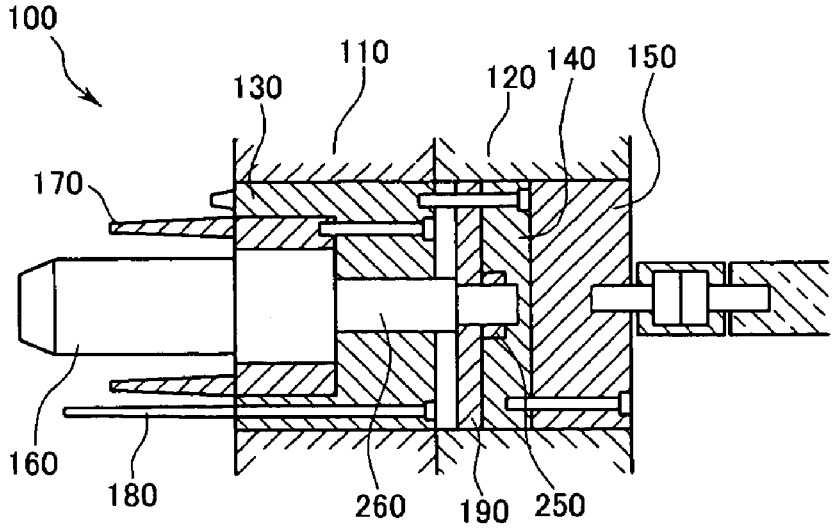
FIG. 3 is a cross-sectional view showing that a head face slide core moves backward according to an exemplary embodiment of the present invention.
Figure 3B:
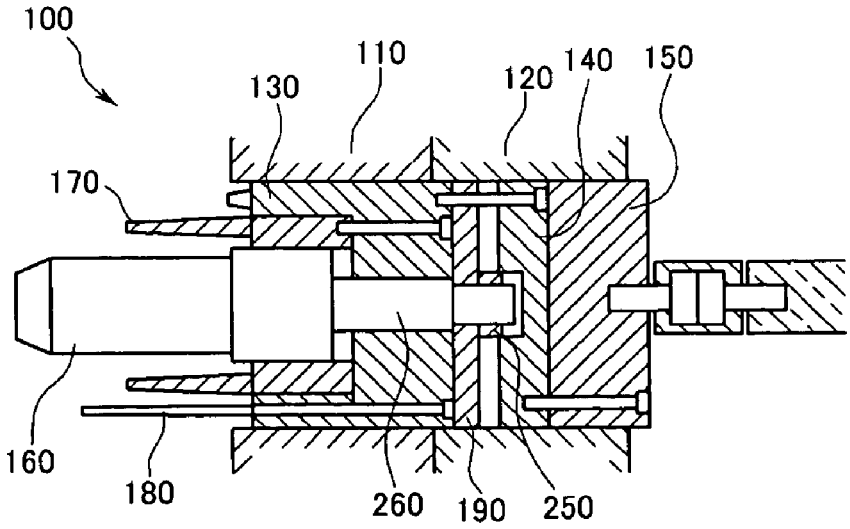
Figure 3C:
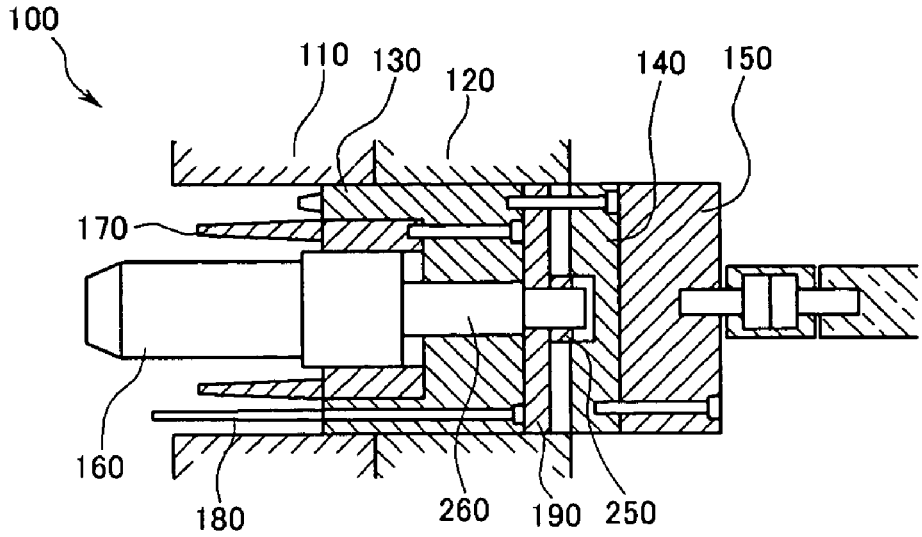

As shown in FIG. 3, when the cylinder 200 pulls back the core holder 150, the second core die 140 coupled to the core holder 150 and the first core die 130 coupled to the second core die 140 move backward. The bore pin return plate 190 slides the distance L along the sliding rod 280, and the bore pin 160, connected to the bore pin return plate 190 does not move. The bore pin return plate 190 then contacts the rear surface of the first core die 130, and is pressed backward by the first core die 130. Accordingly, the bore pin 160, connected to the bore pin return plate 190, moves backward.

Figure 4A:
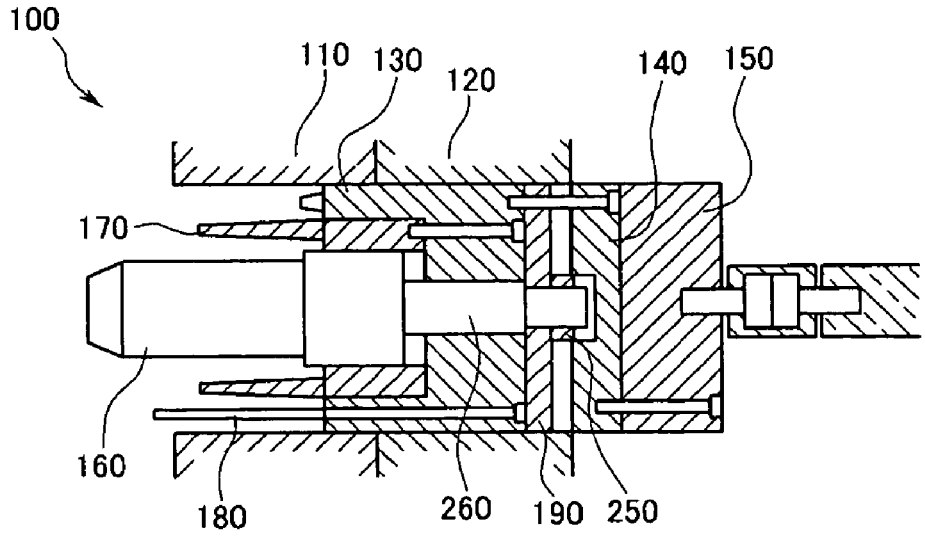
FIG. 4 is a cross-sectional view showing that a head face slide core moves forward according to an exemplary embodiment of the present invention.
Figure 4B:
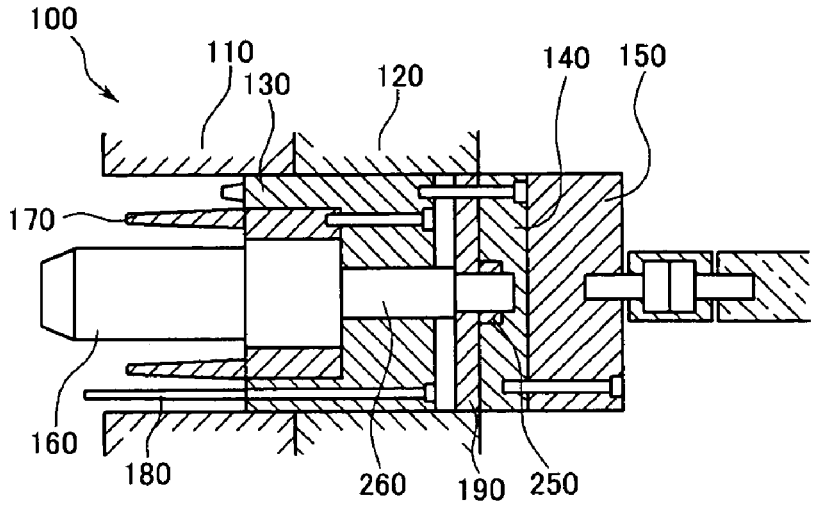
Figure 4C:
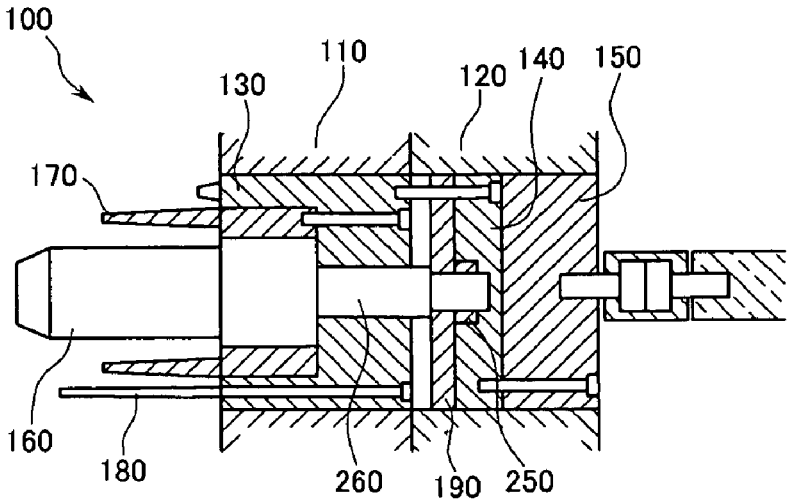

As shown in FIG. 4, when the cylinder 200 pushes the core holder 150, the second core die 140 and the first core die 130 move forward. In this case, the bore pin return plate 190 slides the distance L along the sliding rod 280, and the bore pin 160 does not move. The bore pin return plate 190 then contacts the front surface of the second core die 140, and is pushed forward by the second core die 140. Accordingly, the bore pin 160 moves forward.

When a head face slide core moves backward after a head face of a cylinder block is formed, the first core die firstly moves a predetermined distance, and then the bore pin moves backward. Therefore, after the water jacket forming portion and the head bolt forming portion are separated from the product, the bore pin is separated. Therefore, durability of a head face slide core is improved since an adhesive strength between a product and the head face slide core is dispersed.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A head face slide core of a die casting mold for a cylinder block, comprising:

a first core die comprising a front and a rear surface, the front surface comprising a water jacket forming portion for forming a water jacket, a head bolt forming portion for forming a head bolt, and a bore pin for forming a cylinder bore;

a second core die coupled to the rear surface of the first core die;

a cylinder comprising a piston;

a core holder coupled to a rear surface of the second core die and connected to the piston; and a bore pin return plate disposed between the first and second core dies and connected to the bore pin.

2. The head face slide core of claim 1, wherein the bore pin is connected to the bore pin return plate by an operating rod.

3. The head face slide core of claim 2, wherein the operating rod slides through the first core die.

4. The head face slide core of claim 1, wherein the first core die is coupled to the second core die by a sliding rod.

5. The head face slide core of claim 4, wherein the bore pin return plate slides along the sliding rod a predetermined distance between the first and second core dies.

6. The head face slide core of claim 5, wherein the bore pin return plate moves forward together with the second core die after contacting the second core die when the head face slide core moves forward.

7. The head face slide core of claim 5, wherein the bore pin return plate moves backward together with the first core die after contacting the first core die when the head face slide core moves backward.

8. The head face slide core of claim 2, wherein the operating rod is integrally formed with the bore pin.

* * * * *